United States Patent [19]

Yasuoka et al.

[11] Patent Number: 4,637,362

[45] Date of Patent: Jan. 20, 1987

[54] METHOD FOR CONTROLLING THE SUPPLY OF FUEL FOR AN INTERNAL COMBUSTION ENGINE

[75] Inventors: Akimasa Yasuoka, Tokyo; Takahiro Iwata; Takeo Kiuchi, both of Asaka, all of Japan

[73] Assignee: Honda Kiken Kogyo Kabushiki Kaisha, Tokyo, Japan

[21] Appl. No.: 717,117

[22] Filed: Mar. 28, 1985

[30] Foreign Application Priority Data

Mar. 29, 1984 [JP] Japan ..... 59-061648

[51] Int. Cl.[4] ..... F02M 5/02

[52] U.S. Cl. ..... 123/478; 123/339; 123/480

[58] Field of Search ..... 123/478, 339, 480, 492, 123/493, 494

[56] References Cited

U.S. PATENT DOCUMENTS 4,391,254 7/1983 Staerzl ..... 123/478
4,416,237 11/1983 Doki et al. ..... 123/478
4,549,516 10/1985 Koumura ..... 123/478
4,549,518 10/1985 Koumura ..... 123/478
4,562,808 1/1986 Tominogu et al. ..... 123/339
4,580,535 4/1986 Danno et al. ..... 123/339
4,589,279 5/1986 Mitsuyusu et al. ..... 123/478
4,589,390 5/1986 Wazaki et al. ..... 123/339

*Primary Examiner*—Raymond A. Nelli
*Attorney, Agent, or Firm*—Birch, Stewart, Kolasch & Birch

[57] ABSTRACT

A method for controlling fuel supply of an internal combustion engine includes steps of sampling a vacuum level within an intake pipe of the engine and a value corresponding to engine rotational speed at predetermined sampling intervals, generating a subtraction value $\Delta M_e$ between a latest sampled value $M_{en}$ of the value corresponding to the engine rotational speed and a sampled value $M_{en-m}$ sampled predetermined number of cycles before, and correcting a latest sampled value $P_{BAn}$ of the pressure within the intake pipe in accordance with the subtraction value $\Delta M_e$. The fuel supply amount is determined according to a corrected value $P_{BA}$ of the pressure within the intake pipe of the engine obtained by the above correction process.

18 Claims, 12 Drawing Figures

FIG.5

| | | |
|---|---|---|
| Men 1 | $\beta d1$ | $\beta u1$ |
| Men 2 | $\beta d2$ | $\beta u2$ |
| Men 3 | $\beta d3$ | $\beta u3$ |
| ⋮ | ⋮ | ⋮ |
| Meni | $\beta di$ | $\beta ui$ |

FIG.8

| | | | | |
|---|---|---|---|---|
| Men1 | $\beta 01$ | $\Delta MeGH1$ | $\beta 11$ | $\Delta MeGL1$ |
| Men2 | $\beta 02$ | $\Delta MeGH2$ | $\beta 12$ | $\Delta MeGL2$ |
| Men3 | $\beta 03$ | $\Delta MeGH3$ | $\beta 13$ | $\Delta MeGL3$ |
| ⋮ | ⋮ | ⋮ | ⋮ | ⋮ |
| Meni | $\beta 0i$ | $\Delta MeGHi$ | $\beta Ii$ | MeGL |

METHOD FOR CONTROLLING THE SUPPLY OF FUEL FOR AN INTERNAL COMBUSTION ENGINE

BACKGROUND OF THE INVENTION

1. Field of the Invention

The present invention relates to a method for controlling the supply of fuel for an internal combustion engine.

2. Description of Background Information

Among internal combustion engines for a motor vehicle, there is a type in which fuel is supplied to the engine via a fuel injector or fuel injectors.

As an example, a system is developed in which the pressure within the intake pipe, downstream of the throttle valve, and the engine rotational speed (referred to as rpm (revolutions per minute) hereinafter) is sensed and a basic fuel injection time $T_i$ is determined according to the result of the sensing at predetermined intervals synchronized with the engine rotation. The basic fuel injection time $T_i$ is then multiplied with an increment or decrement correction co-efficient according to engine parameters such as the engine coolant temperature or in accordance with transitional change of the engine operation. In this manner, an actual fuel injection time $T_{out}$ corresponding to the required amount of fuel injection is calculated.

However, in conventional arrangements, hunting of the engine rpm tends to occur especially during idling operation of the engine if the basic fuel injection time period $T_i$ is determined simply according to the engine rpm and the pressure within the intake pipe of the engine detected at a time of control operation.

SUMMARY OF THE INVENTION

An object of the present invention is therefore to provide a method for controlling the fuel supply of an internal combustion engine by which the driveability of the engine is improved with the prevention of the hunting of the engine rpm during the period in which the opening angle of the throttle valve is small, such as the idling period.

According to the present invention, a fuel supply control method comprises a step for sampling the pressure within the intake pipe and a value corresponding to the engine rpm at predetermined sampling intervals, a step for producing a subtraction value $\Delta M_e$ between a latest sampled value $M_{en}$ of the value corresponding to the engine rpm and a sampled value $M_{en-m}$ of the value corresponding to the engine rpm which is sampled at a sampling time a predetermined number (m) of cycles before a latest sampling time, and a step for deriving a corrected value $P_{BA}$ by correcting a latest sampled value $P_{BAn}$ of the pressure within the intake pipe according to the subtraction value $\Delta M_e$, and a step for determining the fuel supply amount in accordance with the thus derived corrected value $P_{BA}$.

Further scope and applicability of the present invention will become apparent from the detailed description given hereinafter. However, it should be understood that the detailed description and specific examples, while indicating a preferred embodiment of the invention, are given by way of illustration only, since various change and modifications within the spirit and the scope of the invention will become apparent to those skilled in the art from this detailed description.

BRIEF DESCRIPTION OF THE DRAWINGS

FIGS. 5 and 8 are diagrams showing data maps stored in the ROM;

DETAILED DESCRIPTION OF THE PREFERRED EMBODIMENT

Figure 1:
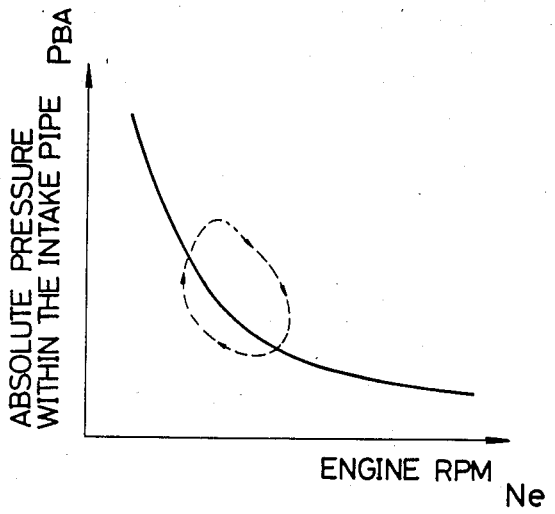
FIG. 1 is a diagram illustrating a relationship between the engine rpm and the pressure within the intake pipe of the engine.

Before entering into the explanation of the preferred embodiment of the invention, reference is first made to FIG. 1 in which the relation between the engine rpm and the absolute pressure $P_{BA}$ within the intake pipe is illustrated.

When the opening angle of the throttle valve is small and maintained almost constant, in such a period of idling operation, the relation between the engine rpm and the absolute pressure $P_{BA}$ becomes such as shown by the solid line of FIG. 1. In this state, a drop of the engine rpm immediately results in an increase of the absolute pressure $P_{BA}$. With the increase of the absolute pressure $P_{BA}$, the fuel injection time becomes long, which in turn causes an increase of the engine rpm $N_e$. On the other hand, when the engine rpm $N_e$ increases, the absolute pressure immediately decreases to shorten the fuel injection time. Thus, the engine torque is reduced to slow down the engine rpm.

In this way, the engine rpm $N_e$ is stabilized.

However, the above described process holds true only when the capacity of the intake pipe is small. If the capacity of the intake pipe is large, the absolute pressure $P_{BA}$ and the engine rpm $N_e$ deviate from the solid line of FIG. 1. Specifically, if the engine rpm drops, the absolute pressure does not increase immediately. Therefore, the fuel injection time remains unchanged and the engine output torque does not increase enough to resume the engine rpm. Thus, the engine rpm $N_e$ further decreases. Thereafter, the absolute pressure $P_{BA}$ increases after a time lag and, in turn, the engine output torque increases to raise the engine rpm $N_e$.

Similarly, the decrease of the absolute pressure $P_{BA}$ relative to the increase of the engine rpm $N_e$ is delayed. With these reasons, the absolute pressure $P_{BA}$ fluctuates as illustrated by the dashed line of FIG. 1 repeatedly.

Thus, in the conventional arrangement where the basic fuel injection time is determined simply from the detected engine rpm and the absolute pressure within the intake manifold detected at a time point of the control operation, a problem of hunting of the engine rpm could not be avoided especially during the idling period of the engine.

Figure 2:
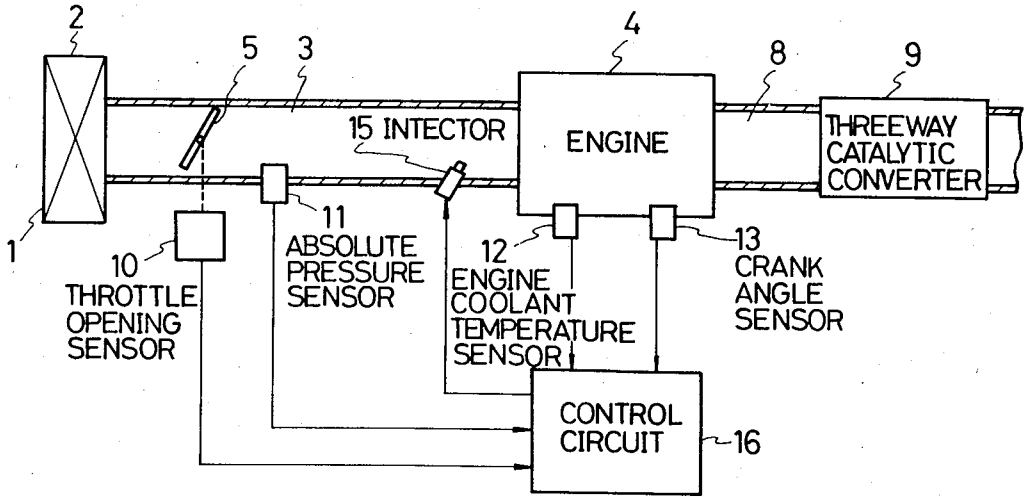
FIG. 2 is a schematic structural illustration of an electronically controlled fuel supply system in which the fuel supply control method according to the present invention is performed.

FIG. 2 is a schematic illustration of an internal combustion engine which is provided with an electronic fuel supply control system operated in accordance with the controlling method according to the present invention. In FIG. 2, the engine designated at 4 is supplied with intake air taken at an air intake port 1 and which passes through an air cleaner 2 and an intake air passage 3. A throttle valve 5 is disposed in the intake air passage 3 so that the amount of the air taken into the engine is controlled by the opening degree of the throttle valve 5. The engine 4 has an exhaust gas passage 8 with a three-way catalytic converter 9 for promoting the reduction of noxious components such as CO, HC, and NOx in the exhaust gas of the engine.

Further, there is provided a throttle opening sensor 10, consisting of a potentiometer for example, which generates an output signal whose level correspondes to the opening degree of the throttle valve 5. Similarly, in the intake air passage 3 on the downstream side of the throttle valve 5, there is provided an absolute pressure sensor 11 which generates an output signal whose level correspondes to an absolute pressure within the intake air passage 3. The engine 4 is also provided with an engine coolant temperature sensor 12 which generates an output signal whose level corresponds to the temperature of the engine coolant, and a crank angle sensor 13 which generates pulse signals in accordance with the rotation of a crankshaft (not illustrated) of the engine. The crank angle sensor 13 is for example constructed so that a pulse signal is produced every 120° of revolution of the crankshaft. For supplying the fuel, an injector 15 is provided in the intake air passage 3 adjacent to each inlet valve (not shown) of the engine 4.

Output signals of the throttle opening sensor 10, the absolute pressure sensor 11, the engine coolant temperature sensor 12, the crank angle sensor 13 are connected to a control circuit 16 to which an input terminal of the fuel injector 15 is also connected.

Figure 3:
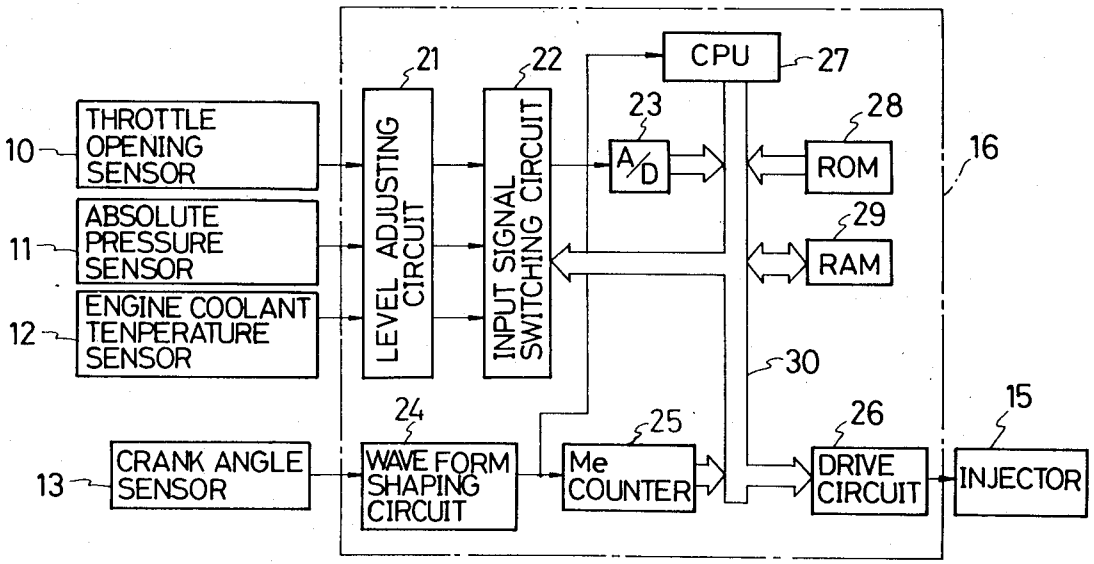
FIG. 3 is a block diagram showing a concrete circuit construction of the control circuit used in the system of FIG. 2.

Referring to FIG. 3, the construction of the control circuit 16 will be explained. The control circuit 16 includes a level adjustment circuit 21 for adjusting the level of the output signals of the throttle opening sensor 10, the absolute pressure sensor 11, the coolant temperature sensor 12. These output signals whose level is adjusted by the level adjusting circuit 21 are then applied to an input signal switching circuit 22 in which one of the input signals is selected and in turn outputted to an A/D (Analog to Digital) converter 23 which converts the input signal supplied in analog form to a digital signal. The output signal of the crank angle sensor 13 is applied to a waveform shaping circuit 24 which provides a TDC (Top Dead Center) signal according to the output signal of the crank angle sensor 13. A counter 25 is provided for measuring the time interval between each pulses of the TDC signal. The control circuit 16 further includes a drive circuit 26 for driving the injector 15, a CPU (Central Processing Unit) 27 for performing the arithmetic operation in accordance with programs stored in a ROM (Read Only Memory) 28 also provided in the control circuit 16, and a RAM 29. The input signal switching circuit 22, and the A/D converter 23, the counter 25, the drive circuit 26, the CPU 27, the ROM 28, and the RAM 29 are mutually connected by means of an input/output bus 30.

With this circuit construction, information of the throttle opening degree $\theta$th, absolute value of the intake air pressure $P_{BA}$, and the engine coolant temperature $T_W$ are alternatively supplied to the CPU 27 via the input/output bus 30. From the counter 25, information of the count value $M_e$ indicative of an inverse number of the engine revolution $N_e$ is supplied to the CPU 27 via the input/output bus 30. In the ROM 28, various operation programs for the CPU 27 and various data are stored previously.

In accordance with this operation programs, the CPU 27 reads the above mentioned various information and calculates the fuel injection time duration of the fuel injector 15 corresponding to the amount of fuel to be supplied to the engine 4, using a predetermined calculation formula in accordance with the information read by the CPU 27. During the thus calculated fuel injection time period, the drive circuit 26 actuates the injector 15 so that the fuel is supplied to the engine 4.

Each step of the operation of the method for controlling the supply of fuel according to the present invention, which is mainly performed by the control circuit 16, will be further explained with reference to the flowchart of FIG. 4.

In this sequencial operation, the absolute value of the intake air pressure $P_{BA}$ and the count value $M_e$ are read by the CPU 27 respectively as a sampled value $P_{BAn}$ and a sampled value $M_{en}$, in synchronism with the occurence of every (nth) TDC signal (n being an integer). These sampled values $P_{BAn}$ and $M_{en}$ are in turn stored in the RAM 29 at a step 51. Subsequently, whether the engine 4 is operating under an idling state or not is detected at a step 52. Specifically, the idling state is detected in terms of the engine coolant temperature $T_W$, the throttle opening degree $\theta$th, and the engine rpm $N_e$ derived from the count value $M_e$.

When the engine is not operating under the idling condition, which satisfys all of the conditions that the engine coolant temperature is high, the opening degree of the throttle valve is small, and the engine rpm is low, whether the engine rpm $N_e$ is higher than a predetermined value $N_z$ or not is detected at a step 53.

If $N_e \leqq N_z$, whether or not the sampled value $P_{BAn}$ is greater than a predetermined value $P_{BO}$ ($P_{BO}$ being about atmospheric pressure value) is detected at a step 54. If $P_{BAn} \leqq P_{BO}$, a sampled value $P_{BAn-2}$, that is a before preceding sampled value (a value sampled at a sampling time 2 cycles before the latest sampling time), is read out from the RAM 29 at a step 55. Then a subtraction value $\Delta P_{BA}$ between the latest sampled value $P_{BAn}$ and the sampled value $P_{BAn-2}$ is calculated at a step 56. The sampled value $P_{BAn}$ of the absolute value of the intake air pressure $P_{BA}$ and the sampled values $M_{en}$ of the count value $M_e$ are stored in the RAM 29, for example, for the last six cycles of sampling. At a step 57, the subtraction value $\Delta P_{BA}$ is compared with a predetermined reference value $\Delta P_{BAGH}$, corresponding to 64 mmHg for example. If $\Delta P_{BA} \leqq \Delta P_{BAGH}$, a multiplication factor $\phi$ (for example, 4) is multiplied to the subtraction value $\Delta P_{BA}$ and the sampled value $P_{BAn}$ is added to the product at a step 58. Thus, the corrected value $P_{BA}$ of the latest sampled value $P_{BAn}$ is calculated. If $\Delta P_{BA} > \Delta P_{BAGH}$, the subtraction value $\Delta P_{BA}$ is made equal to the predetermined valu $\Delta P_{BAGH}$ at a step 59 and the program goes to the step 58.

After that, whether or not the corrected value $P_{BA}$ is greater than a predetermined value $P_{BO}$ is detected at a step 60. If $P_{BA} \leqq \Delta P_{BO}$, the basic fuel injection time $T_i$ is determined in accordance with the corrected value $P_{BA}$, at a step 61, using a data map stored in ROM 28 previously. If $P_{BA} > P_{BO}$, then the corrected value $P_{BA}$ is made equal to $P_{BO}$ at a step 62 and the program goes to the step 61.

If $N_e > N_z$ at the step 53 or if $P_{BAn} > P_{BO}$ at the step 54, the latest sampled value $P_{BAn}$ is used as the corrected value $P_{BA}$ at the step 63 and afterwards, the program goes to the step 61.

On the other hand, at the step 52, if it is detected that the engine is operating under the idling condition, a sampled value $M_{en-6}$ of the count value $M_e$ which is sampled at a sampling time six cycles before the sampling time of the latest sampled value $M_{en}$ is read out from the RAM 29 at a step 64. Then, a subtraction value $\Delta M_e$ between the latest sampled value $M_{en}$ and the sampled value $M_{en-6}$ is calculated at a step 65. After that, whether or not the subtraction value $\Delta M_e$ is smaller than 0 is detected at a step 66. If $\Delta M_e \geqq 0$, it indicates that the engine rpm is dropping. Therefore, a correction coefficient $\beta d$ corresponding to the latest sampled value $M_{en}$ is looked up, at a step 67, from the data map previously stored in the ROM 28 in such a manner as illustrated in FIG. 5.

By multiplying the thus obtained correction coefficient $\beta d$ to the subtraction value $\Delta M_e$ and adding a value 1 to the product, a correction coefficient $\alpha$ is calculated at a step 68. Then, whether or not this correction coefficient $\alpha$ is greater than an upper limit value $\alpha_{GH}$, is detected at a step 69. If $\alpha > \alpha_{GH}$, then the correction coefficient $\alpha$ is made equal to the upper limit value $\alpha_{GH}$ at a step 70. Conversely, if $\alpha \leqq \alpha_{GH}$, the value of the correction coefficient $\alpha$ is maintained. A corrected value $P_{BA}$ of the latest sampled value $P_{BAn}$ is calculated at the step 71 and the basic fuel injection time $T_i$ is calculated according to the thus corrected value of $P_{BA}$ at the step 61.

At the step 66, if $\Delta M_e < 0$, it indicates that the engine rpm is going up and as in the step 67 mentioned above the correction coefficient $\beta u$ corresponding to the latest sampled value $M_{en}$ is looked up from the data map previopusly stored in the ROM 28 as illustrated in FIG. 5 at a step 72. Subsequently, at a step 73, a correction coefficient $\alpha$ is calculated by multiplying the correction constant $\beta u$ to the subtraction value $\Delta M_e$ and adding a value of 1 to the product.

Then, whether or not this correction coefficient $\alpha$ is smaller than a lower limit value $\alpha_{GL}$ (0.9 for example) is detected at a step 74. If $\alpha < \alpha_{GL}$, the correction coefficient $\alpha$ is made equal to the lower limit value $\alpha_{GL}$ at a step 75. If $\alpha \geqq \alpha_{GL}$, the value of the correction coefficient $\alpha$ is maintained as it is. Then the calculation operation goes to the step 71 where the correction value $P_{BA}$ of the latest sampled value $P_{BAn}$ is derived.

In this embodiment of the fuel supply control method according to the present invention, the correction of the sampled value $P_{BAn}$ is performed according to two equations $\alpha = 1 + \beta \Delta M_e$, and $P_{BA} = \alpha . P_{BAn}$. The amount of the correction of the sampled value $P_{BAn}$ is determined in proportional to the magnitude of the subtraction value $\Delta M_e$ which corresponds to the variation of the engine rpm.

Figure 6:
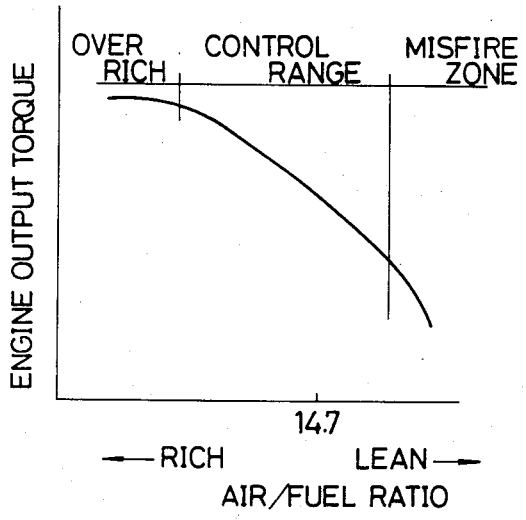
FIG. 6 is a diagram showing relationship between the engine output power and the air/fuel ratio.

The correction constant $\beta$ is looked up from a data map of $M_{en} - \beta d - \beta u$ shown in FIG. 5 since the subtraction value $\Delta M_e$ with respect to the same width $\Delta N_e$ of variation of the engine rpm becomes larger rapidly as the engine rpm becomes lower. Also, for improving the accuracy of the correction value $P_{BA}$, one of the correction constants $\beta d$ and $\beta u$ is derived in accordance with the polarity of the subtraction value $\Delta M_e$. Specifically, when the engine rpm is reducing, the correction constant $\beta d$ is looked up from the table and when the engine rpm is increasing, the correction constant $\beta u$ which is set to be smaller than $\beta d$ is looked up from the table. The correction coefficient $\alpha$ indicates the degree of the shift of the air/fuel ratio towards the rich side or the lean side, of the mixture to be supplied to the engine. Therefore, by providing the upper limit $\alpha_{GH}$ and the lower limit $\alpha_{GL}$ for the correction coefficient $\alpha$, the correction coefficient $\alpha$ is controlled within the range where the engine output torgue can be controlled stably by controlling the air/fuel ratio as exemplary shown in FIG. 6. More particularly, if $\alpha > \alpha_{GH}$, the air/fuel ratio becomes over rich so that it gets off from the range and does not control the engine output torque and if $\alpha < \alpha_{GL}$, there is a fear of misfire.

Figure 7:
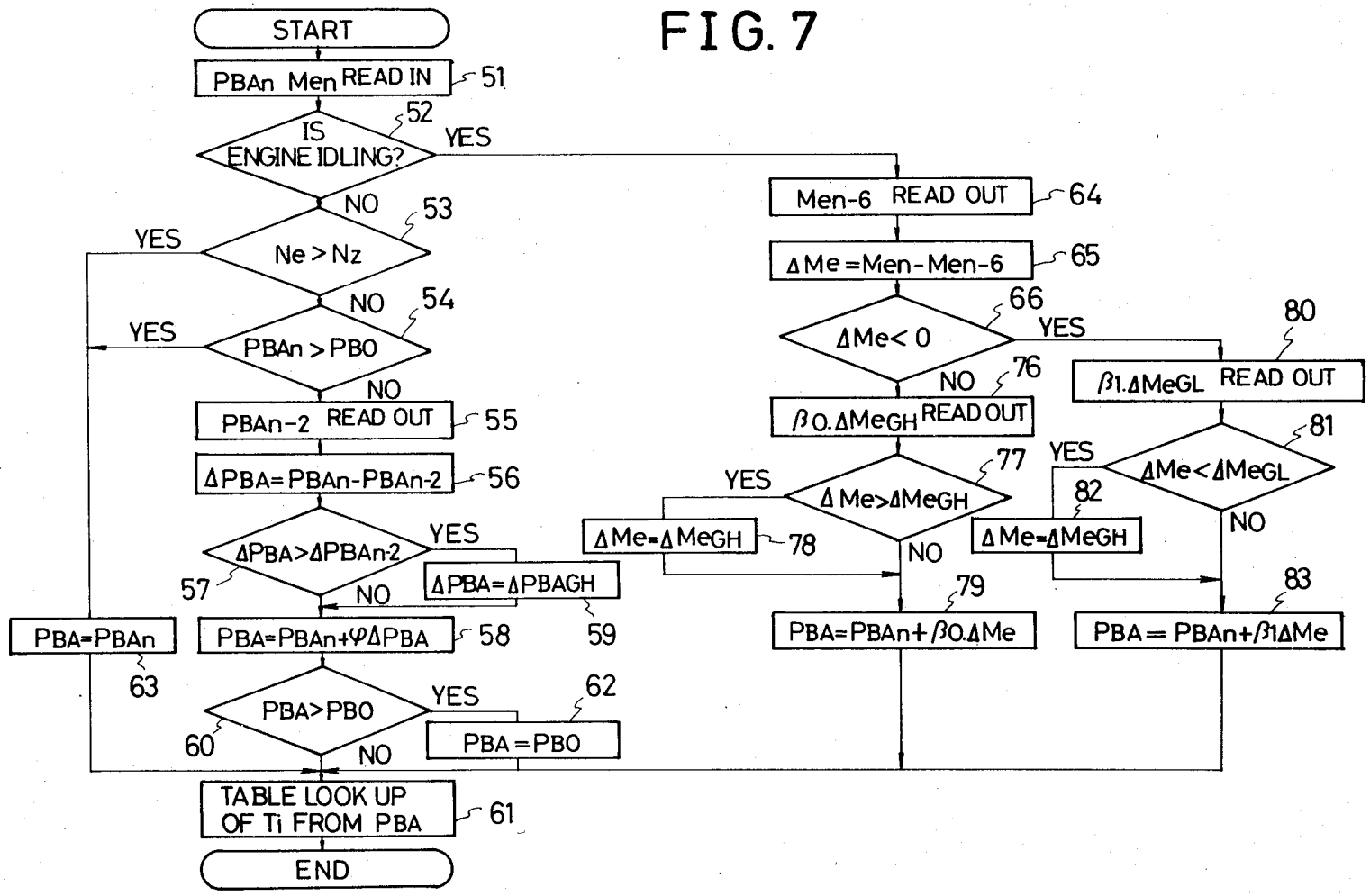
FIGS. 7, 9 and 10 are flowcharts respectively showing operations of the control circuit in other embodiments according to the present invention.

The flowchart of FIG. 7 shows an operational sequence of another embodiment of the method for controlling the fuel supply according to the present invention.

Figure 4:
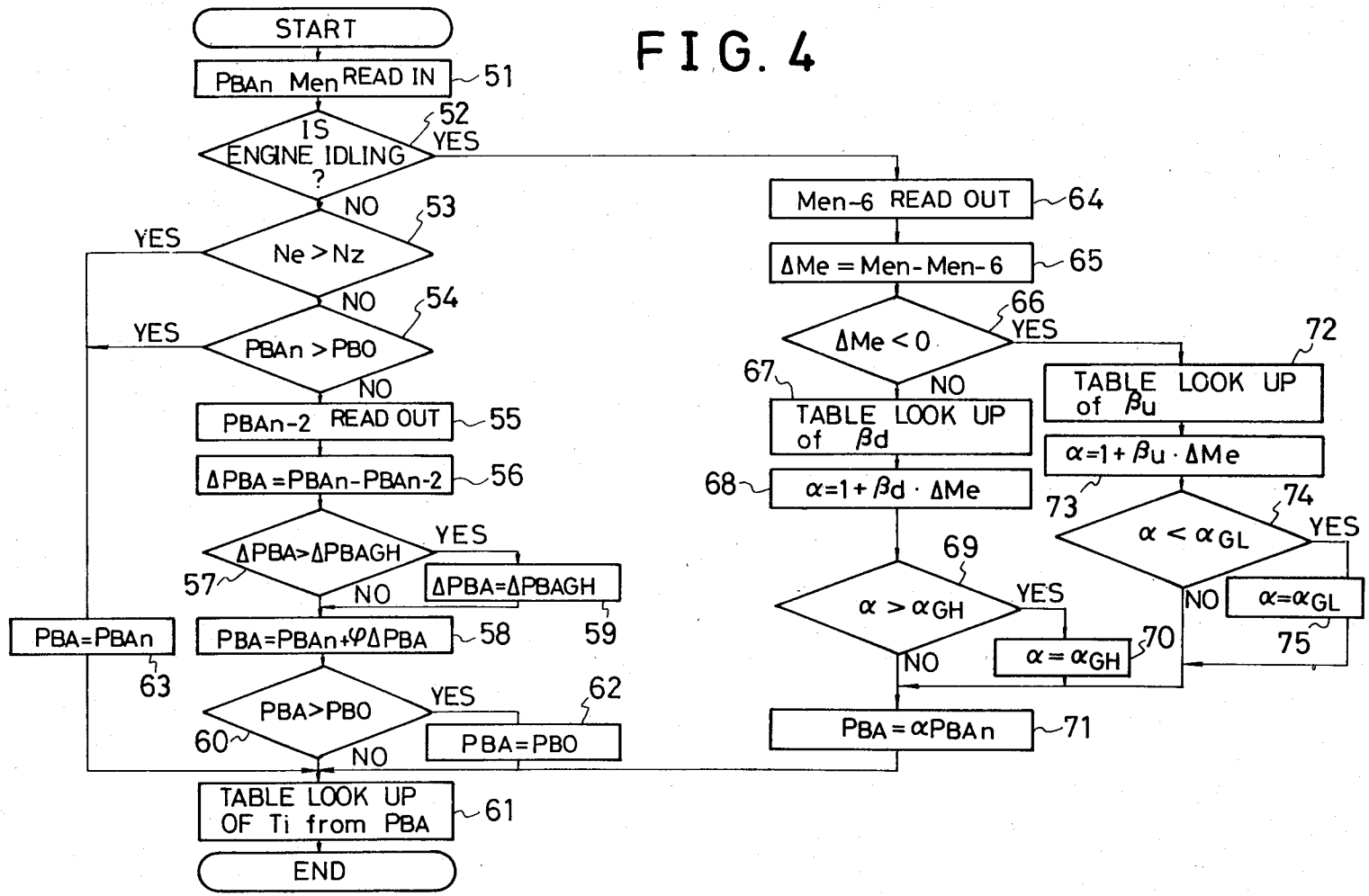
FIG. 4 is a flowchart showing an embodiment of the fuel supply control method according to the present invention.

In this sequence, since the steps up to the detection of $\Delta M_e < 0$ at the step 66, are the same as the corresponding steps in the flowchart of FIG. 4, the same reference numerals are used and the explanation thereof is omitted.

If the result of the detection at the step 66 indicates that $\Delta M_e \geqq 0$ due to the drop of the engine rpm, the correction coefficient $\beta_0$ and the upper limit value $\Delta M_{eGH}$ of the subtraction value $\Delta M_e$ corresponding to the latest sampled value $M_{en}$ respectively are looked up from the table stored previously in the ROM 28 as shown in FIG. 8 at a step 76. Then whether or not the subtraction value $\Delta M_e$ is greater than the upper limit value $\Delta M_{eGH}$ is detected at a step 77. If $\Delta M_e > \Delta M_{eGH}$, it indicates that the air/fuel ratio is over rich, then the subtraction value $\Delta M_e$ is made equal to the upper limit value $\Delta M_{eGH}$ at a step 78. Conversely, if $\Delta M_e \leqq \Delta M_{eGH}$, the subtraction value $\Delta M_e$ is maintained as it is. Subsequently, the correction value $P_{BA}$ of the latest sampled value $P_{BAn}$ is calculated in such manner that the correction constant $\beta_0$ is multiplied to the subtraction value $\Delta M_e$ and the latest sampled value $P_{BAn}$ is added to the product at a step 79. On the other hand, if the result of the detection at the step 66 is $\Delta M_e < 0$ due to the rise the engine rpm, then the correction constant $\beta_1$ and the lower limit value $\Delta M_{eGL}$ of the subtraction value $\Delta M_e$ corresponding to the latest sampled value $M_{en}$ respectively are looked up, at a step 80, from data map which is previously stored in the ROM 28 in such a manner as illustrated in FIG. 8. Subsequently, whether or not the subtraction value $\Delta M_e$ is smaller than the lower limit value $\Delta M_{eGL}$ is detected at a step 81. If $\Delta M_e < \Delta M_{eGL}$, the subtraction value $\Delta M_e$ is made equal to the lower limit value $\Delta M_{eGL}$ at a step 82. This is because otherwise the air/fuel ratio becomes over lean and which in turn causes a misfire. Conversely if $\Delta M_e \geqq \Delta M_{eGL}$, then the value of the subtraction value $\Delta M_e$ is maintained as it is. Subsequently, the corrected value $P_{BA}$ of the latest sampled value $P_{BAn}$ is calculated at a step 83 in such a manner that the correction constant $\beta_1$ is multiplied to the subtraction value $\Delta M_e$ and the latest sampled value $P_{BAn}$ is added to the product.

In the thus operated method for controlling the fuel supply of an internal combustion engine, the latest sampled value is basically corrected according to the equation $P_{BA} = P_{BAn} + \beta \Delta M_e$, and the amount of correction is determined in accordance with the subtration value $\Delta M_e$. For improving the accuracy of the correction, the correction constant $\beta$ is determined in accordance with the polarity of the subtraction value $\Delta M_e$ and the value of the latest sampled value $M_{en}$. In addition, for limiting the correction constant $\beta$ to the range where the engine output torque is controlled in accordance with the adjustment of the air/fuel ratio, the upper limit value $\Delta M_{eGH}$ and the lower limit value $\Delta M_{eGL}$ are determined in accordance with the polarity of the subtraction value $\Delta M_e$ and the latest sampled value $M_{en}$.

Figure 9:
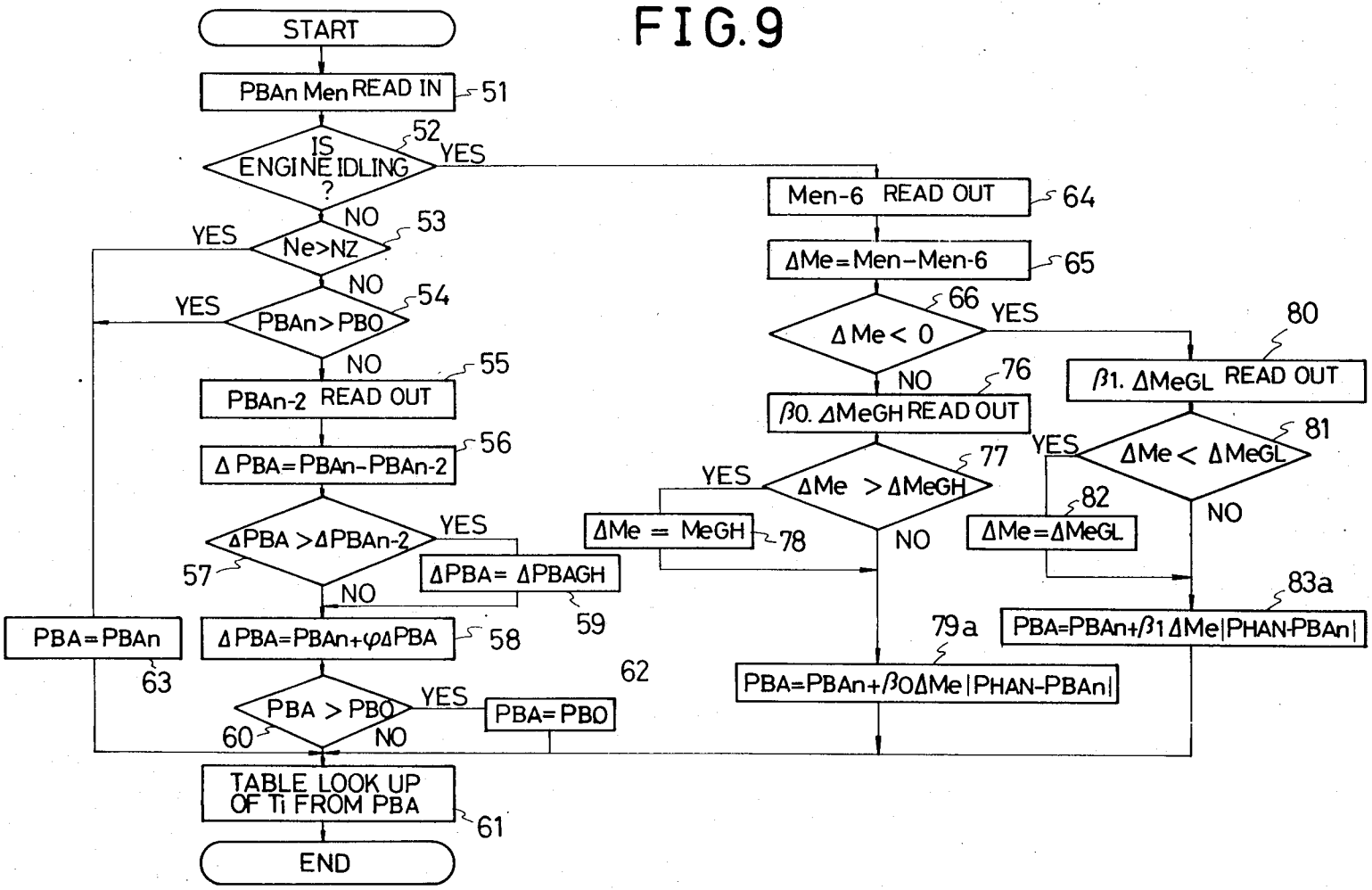
Figure 10:
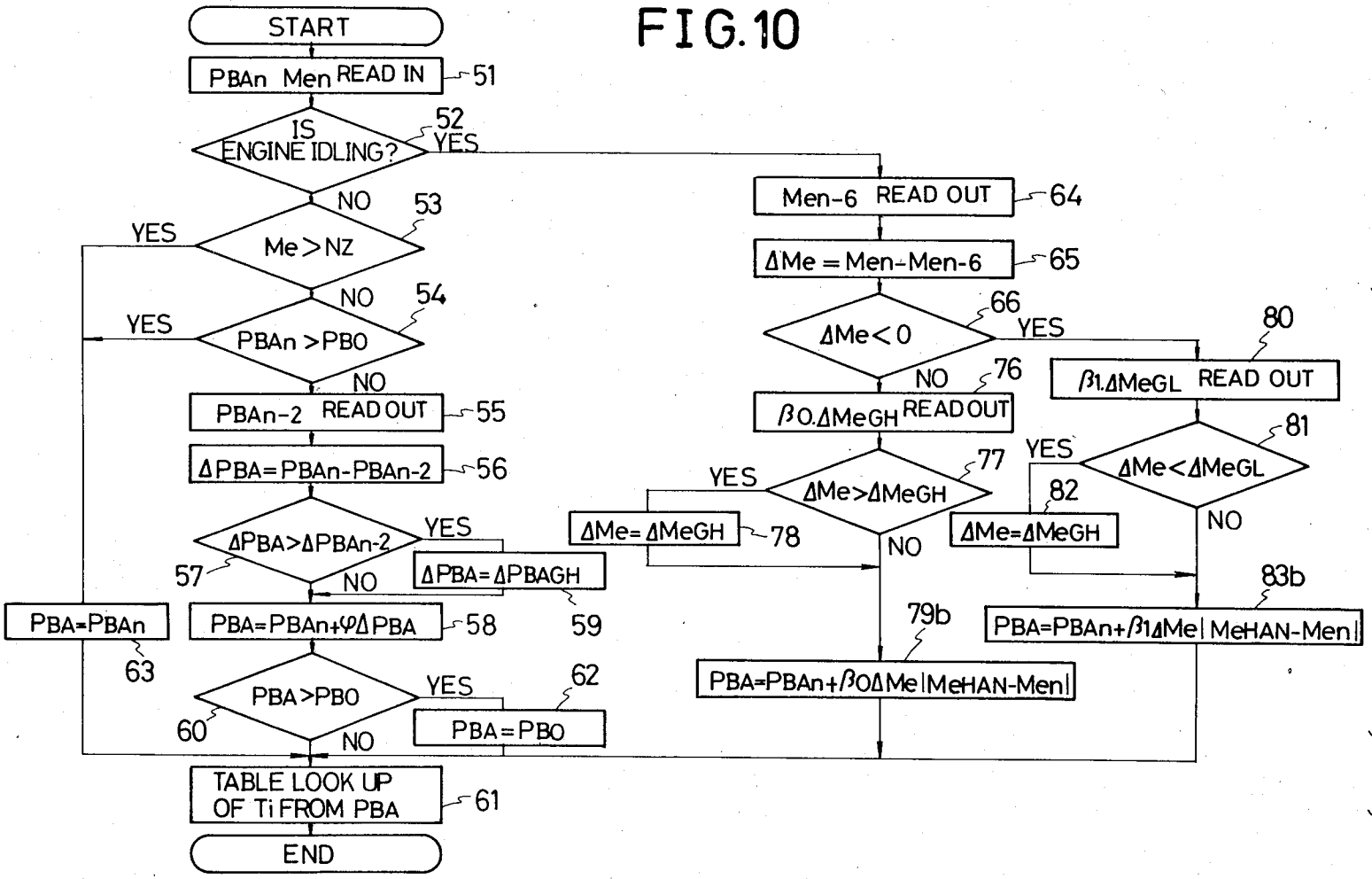

FIGS. 9 and 10 illustrate the other embodiment of the method for controlling the fuel suppy according to the present invention.

In the operational sequence of these embodiments, the correction is performed basically in accordance with the formula of $P_{BA}=P_{BAn}+\beta\Delta M_e$ used in the flowchart as shown in FIG. 7.

Therefore, the steps up to the step for determining the subtraction value $\Delta M_e$ is the same as the steps in the previous embodiments.

Figure 11:
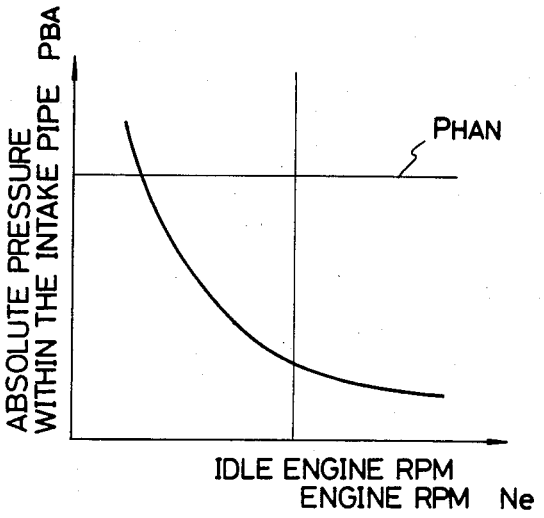
FIGS. 11 and 12 are diagram showing the constants $P_{HAN}$ and $M_{eHAN}$.
Figure 12:
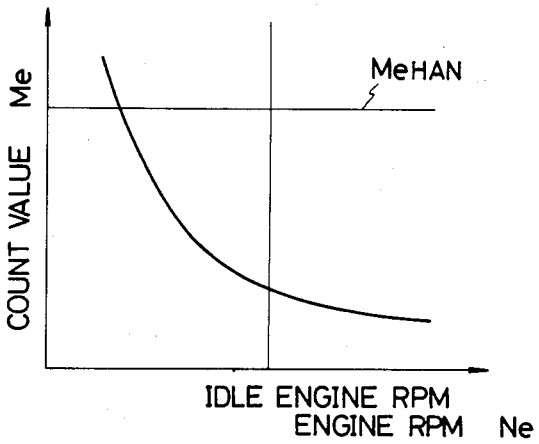

However, since the subtraction value $\Delta M_e$ becomes larger very quickly with respect to the same width $\Delta N_e$ of variation of the engine rpm as the engine rpm becomes lower, the amount of the correction tends to be excessive. Therefore it is desirable to prevent the excessive increase of the corrected value by using an equation $P_{BA}=P_{BAn}+\beta\Delta M_e/M_e$. However, the calculation of such a formula as $\Delta M_e/M_e$ in a computer for example, requires a relatively long calculation time. Therefore, in these embodiments, constants $P_{HAN}$ or $M_{eHAN}$ (shown in FIG. 11 or 12 respectively) is established and an approximate value of $1/M_e$, $|P_{HAN}-P_{BAN}|$ or $|M_{eHAN}-M_{en}|$ is calculated in these embodiments. As shown in FIG. 9, after setting the subtraction value $\Delta M_e$ at the step 77 or the step 78, the corrected value $P_{BA}$ of the latest sampled value $P_{BAn}$ is calculated at a step 79*a* according to an equation $P_{BA}=P_{BAn}+\beta_0\Delta M_e|P_{HAN}-P_{BAn}|$. In addition, after the subtraction value $\Delta M_e$ is set at the step 81 or the step 82, the corrected value $P_{BA}$ is calculated according to an equation $P_{BA}=P_{BAn}+\beta_1\Delta M_e|P_{HAN}-P_{BAn}|$ at a step 83*a*.

Similarly, in FIG. 10, after setting the subtraction value $\Delta M_e$ at the step 77 or the step 78, the corrected value $P_{BA}$ is calculated according to an equation $P_{BA}=P_{BAn}+\beta_0\Delta M_e|M_{eHan}-M_{en}|$ at a step 79*b*. In addition, after the subtraction value $\Delta M_e$ is set at the step 81 or the step 82, the corrected value $P_{BA}$ is calculated according to an equation $P_{BA}=P_{BAn}+\beta_1\Delta M_e|M_{eHAN}-M_{en}|$ at a step 83*b*.

Thus, according to the fuel supply control method of the present invention, the detected value of the pressure within the intake pipe is corrected according to the amount of the variation of the engine rpm. Therefore, the sampled value of the pressure within the intake pipe after the correction varies following the the variation of the engine rpm. Thus, a relationship between the engine rpm and the absolute pressure within the intake pipe which substantially locates on the curve shown by the solid line in FIG. 1 is obtained.

By determining the fuel supply amount according to the sampled value of the pressure within the intake pipe after the correction, the engine operation during such a period as the idling period is stabilized and the driveablilty of the engine is very much improved. This is because the phase delay of the restoring torque of the engine with respect to the change in the engine rpm is reduced even if the capacity of the intake pipe of the engine is relatively large.

What is claimed is:

1. A method for controlling fuel supply of an internal combustion engine having a throttle valve and fuel supply means, according to the pressure within an intake pipe, comprising the steps of:

(a) sampling said pressure within the intake pipe, with a pressure sensing means, and sampling a value corresponding to the internal combustion engine rotational speed, with a rotational sensing means, at predetermined sampling intervals;

(b) producing a subtraction falue $\Delta M_e$ by subtracting from the latest sampled value $M_{en}$, of said value corresponding to engine rotational speed, a sampled value $M_{en-m}$ which was sampled at a sampling time a predetermined number (m) of cycles before a sampling time of the latest sampled value $M_{en}$;

(c) producing a corrected value $P_{BA}$ by correcting a latest sampled value $P_{BAn}$ of said pressure within the intake pipe according to said subtraction value $\Delta M_e$;

(d) determining a fuel supply amount according to the said corrected value $P_{BA}$; and (e) driving said fuel supply means for supplying a fuel to the internal combustion engine in response to said fuel supply amount determined according to said corrected value $P_{BA}$.

2. The method as claimed in claim 1, wherein said step of producing a corrected value $P_{BA}$ is performed during a period of time when the internal combustion engine is operating under an idling state.

3. The method as claimed in claim 1, wherein said step of producing a corrected value $P_{BA}$ comprises steps of:

multiplying a constant $\beta$, representing degree of correction, to said subtraction value $\Delta M_e$ and adding a value of 1 to produce a value $1+\beta\Delta M_e$; and multiplying said latest sampled value $P_{BA}$ with said value $1+\beta\Delta M_e$ to produce the corrected value $P_{BAn}$.

4. The method as claimed in claim 3, wherein an upper limit value is set to said value $1+\beta\cdot\Delta M_e$.

5. The method as claimed in claim 3, wherein a lower limit value is set to said value $1+\beta\cdot\Delta M_e$.

6. The method as claimed in claim 3, wherein said constant $\beta$ takes different values depending on polarity of said subtraction value $\Delta M_e$.

7. The method as claimed in claim 3, wherein said constant $\beta$ is varied in accordance with the internal combustion engine rotational speed.

8. The method as claimed in claim 1, wherein said step of producing a corrected value $P_{BA}$ comprises steps of:

multiplying a constant $\beta$, representing degree of correction to said subtraction value $\Delta M_e$ and adding said latest sampled value $P_{BAn}$ to produce said corrected value $P_{BA}$.

9. The method as claimed in claim 8, wherein an upper limit value is set to said subtraction value $\Delta M_e$.

10. The method as claimed in claim 8, wherein a lower limit value is set to said subtraction value $\Delta M_e$.

11. The method as claimed in claim 9, wherein said upper limit value is varied according to the rotational speed of the internal combustion engine.

12. The method as claimed in claim 10, wherein said lower limit value is varied according to the rotaional speed of the internal combustion engine.

13. The method as claimed in claim 8, wherein said constant $\beta$ takes different values depending on polarity of said subtraction value $\Delta M_e$.

14. The method as claimed in claim 1, wherein said step of producing a corrected value $P_{BA}$ comprises steps of:

generating an absolute value of a subtraction value obtained by subtracting the latest sampled value of the pressure within the intake pipe from a predetermined pressure value $P_{HAN}$;

generating a subtraction value $\Delta M_e$ by subtracting from a latest sampled value $M_{en}$ of an inverted value of the engine rotational speed a sampled a value $M_{en-m}$ sampled predetermined number (m) of cycles before;

multiplying a constant $\beta$, representing a degree of correction, and said absolute value to said subtraction value $\Delta M_e$; and adding a latest sampled value $P_{BAn}$ to a product obtained by said multiplying step.

15. The method as claimed in claim 1, wherein said step of producing a corrected value $P_{BA}$ comprises steps of:

generating an absolute value of a subtraction value obtained by subtracting from a predetermined inverted value $M_{eHAN}$ of the engine rotational speed a latest sampled value $M_{en}$ of an inverted value of the engine rotational speed;

generating a subtraction value $\Delta M_e$ by subtracting from the latest sampled value $M_{en}$ of the inverted value of the engine rotational speed a sampled value $M_{en-m}$ sampled a predetermined number (m) of cycles before;

multiplying a constant $\beta$ representing a degree of correction and said absolute value to said subtraction value $\Delta_{Me}$; and adding a latest sampled value $P_{BAn}$ to a product obtained by said multiplying step.

16. The method according to claim 1, wherein the fuel supply means is a fuel injector.

17. The method according to claim 1, wherein the method is for controlling fuel supply for an internal combustion engine having a throttle valve according to a pressure within an intake pipe downstream of the throttle valve.

18. The method according to claim 1, wherein the method is for controlling fuel supply for an internal combustion engine having a throttle valve and a fuel injector according to a pressure within an intake pipe downstream of the throttle valve.

* * * * *